US010299547B2

(12) United States Patent
Reil et al.

(10) Patent No.: US 10,299,547 B2
(45) Date of Patent: May 28, 2019

(54) SAFETY CLUTCH

(71) Applicant: Goran Reil, Gardena, CA (US)

(72) Inventors: Vladimir Reil, Rancho Palos Verdes, CA (US); Goran Reil, Las Vegas, NV (US)

( * ) Notice: Subject to any disclaimer, the term of this patent is extended or adjusted under 35 U.S.C. 154(b) by 182 days.

(21) Appl. No.: 15/222,443

(22) Filed: Jul. 28, 2016

(65) Prior Publication Data

US 2018/0027932 A1 Feb. 1, 2018

(51) Int. Cl.

| | |
|---|---|
| ***A44C 7/00*** | (2006.01) |
| ***B21D 22/02*** | (2006.01) |
| ***A44C 15/00*** | (2006.01) |

(52) U.S. Cl.

CPC ..... *A44C 7/003* (2013.01); *A44C 15/0035* (2013.01); *B21D 22/02* (2013.01); *A44D 2201/32* (2013.01); *Y10T 24/41* (2015.01)

(58) Field of Classification Search

CPC ..... Y10T 24/41; Y10T 24/44376; Y10T 24/4604; Y10T 24/4605; Y10T 24/4609; Y10T 24/4611; Y10T 24/4613; Y10T 24/4621; Y10T 24/46; A44C 7/003; A44D 2201/32

See application file for complete search history.

(56) References Cited

U.S. PATENT DOCUMENTS

| | | | | |
|---|---|---|---|---|
| 1,023,663 A | | 4/1912 | Kubicek | |
| 1,024,762 A | | 4/1912 | Anderson | |
| 1,035,694 A | | 8/1912 | Diefenbacher | |
| 1,229,089 A | * | 6/1917 | Johnson | A44B 9/10 24/706.5 |
| 1,281,844 A | | 10/1918 | Roy | |
| 3,088,295 A | * | 5/1963 | Haines | A44B 1/04 24/108 |
| 4,397,067 A | | 8/1983 | Rapseik | |

(Continued)

FOREIGN PATENT DOCUMENTS

| | | |
|---|---|---|
| EP | 1297760 A2 | 4/2003 |
| JP | S60158413 U | 10/1985 |
| JP | 2008237267 | 10/2008 |

OTHER PUBLICATIONS

Dama, Website pages showing clutches, before Jul. 2016.

(Continued)

*Primary Examiner* — Robert Sandy
*Assistant Examiner* — Michael S Lee
(74) *Attorney, Agent, or Firm* — Canady & Lortz LLP; Bradley K. Lortz

(57) ABSTRACT

A safety clutch for releasable securing of a post for a body piercing is disclosed. The post is guided through a hole in a plate to be secured (but removable) between a pair of cantilever spring elements bent from the edges of the plate into position on the back side of the plate. A dome shield is also secured to the edge of plate to cover the cantilever spring elements on back side of the clutch, the dome shield including one or more ventilation holes for reducing moisture accumulation within the dome shield. The dome shield blocks an end of the post extending between the cantilever spring elements from contacting the user and possibly puncturing skin. The plate, dome shield and cantilever spring elements can be efficiently manufactured by forming and stamping from a single piece of material.

10 Claims, 8 Drawing Sheets

(56) References Cited

U.S. PATENT DOCUMENTS

| | | | |
|---|---|---|---|
| 4,501,050 | A | 2/1985 | Fountoulakis |
| 4,630,453 | A | 12/1986 | Burkett |
| 4,843,699 | A | 7/1989 | Seidman |
| 4,928,367 | A | 5/1990 | Seidman |
| 5,375,433 | A | 12/1994 | Skalet |
| 5,893,277 | A | 4/1999 | Biagi |
| 6,105,392 | A | 8/2000 | Biagi |
| D435,233 | S | 12/2000 | Fountoulakis |
| 7,013,675 | B2 | 3/2006 | Marquez-Pickering |
| 8,365,369 | B1 | 2/2013 | Fountoulakis |
| 8,677,781 | B2 | 3/2014 | Stoilas |
| 2004/0237584 | A1 | 12/2004 | Lee |
| 2005/0097715 | A1 | 5/2005 | Rissin et al. |
| 2005/0120743 | A1 | 6/2005 | Pickering |
| 2010/0162540 | A1 | 7/2010 | Rissin et al. |
| 2011/0099777 | A1 | 5/2011 | Corry |
| 2011/0191991 | A1 | 8/2011 | Meneau |

OTHER PUBLICATIONS

PCT International Search Report and Written Opinion of International Application No. PCT/US2017/043658, dated Oct. 4, 2017.

* cited by examiner

SAFETY CLUTCH

BACKGROUND OF THE INVENTION

1. Field of the Invention

The present invention relates to apparatuses and methods for ornamental piercing of body parts. Particularly, the present invention relates to apparatuses and methods for producing a clutch for safely securing a post of a body piercing on a user.

2. Description of the Related Art

In recent years, body piercing has become a increasingly common practice in the U.S. and throughout the world. Although the piercing of body parts is ancient, the practice is rapidly becoming a routine procedure, often performed by laypersons without medical experience or training. It is also important to understand that mainstream body piercing has evolved to include piercing of body parts other than just the ear. For example, piercing of flesh near the naval or belly button, eyebrow, lip, etc., are presently much more common than previously. Presently, a number of manually operated devices are available that allow for the safe, hygienic, user-friendly piercing of body parts. Examples of such systems are disclosed in U.S. Pat. No. 4,527,563, issued Jul. 9, 1985, to Reil, U.S. Pat. No. 4,921,494, issued May 1, 1990, to Reil, U.S. Pat. No. 5,496,343 by Reil, issued Mar. 5, 1996, U.S. Pat. No. 5,792,170 by Reil, issued Aug. 11, 1998, U.S. Pat. No. 5,868,774 by Reil, issued Feb. 9, 1999, U.S. Pat. No. 6,599,306 by Reil, issued Jul. 29, 2003, U.S. Pat. No. 6,796,990 by Reil, issued Sep. 28, 2004, U.S. Pat. No. 7,955,349, issued Jun. 7, 2011 to Reil, and U.S. Pat. No. 8,372,106, issued Feb. 12, 2013 to Reil et al., all of which are incorporated by reference herein.

In addition to piercing entirely by hand with a needle, there are a variety of body piercing systems available today. These various body piercing systems essentially comprise a stud (also known as an earring or a piercing earring) which includes an affixed ornamental piece with a post (also known as a stud, pin or a piercing pin) extending therefrom and a clutch (also known as a nut or clasp) that are mounted in a cartridge. During the piercing process, the body part (e.g., an ear lobe) is placed between the post and the nut and the cartridge is squeezed, either by hand or by operating it in a special body piercing system (or instrument, assembly or "gun"), which causes the post to pierce the body part and engage the clutch.

A clutch (also known as a nut or clasp) is commonly used in most body piercing to engage the post of the earring stud on the back side of the piercing. A clutch can be employed as part of a cartridge system, such as those referenced above, or can also be used to close a body piercing performed by hand. A conventional clutch comprises a small ribbon of metal having a hole through the middle and both ends bent backward into loops that contact each other behind the hole. The post of a body piercing passes through the hole and held by the spring force between the contacting loops. Over the years, various other designs for clutches have been developed as well.

For example, some clutches may include a shield which prevents the end of the post from contacting the user's skin in order to reduce the risk of skin irritation or infection. Various techniques for securing the post in the clutch have also been developed. For example, a clutch may comprise a element having a blind hole which includes a soft material of some type which the post penetrates to be held. Some clutches may lock to the post. Some clutches may be designed to operate with a particular post design, e.g. having a notch in the post. The various existing unique clutch designs typically emphasize a particular benefit, e.g. hygiene or locking. Some examples of clutches employed in body piercing are as follows.

U.S. Pat. No. 4,501,050, issued Feb. 26, 1985, to Fountoulakis, discloses a clutch for post earrings. The clutch comprises a housing which is open at one end thereof and has an aperture therethrough in the opposite end thereof, a cap member which is received on the open end of the housing and also has an aperture therethrough, and a pair of resilient leaves which extend inwardly in the housing from the cap member in integral relation therewith and in converging relation with respect to each other, the leaves preferably meeting in substantially face-to-face relation at a point spaced from the cap member. The clutch is receivable on a post earring so that the post of the earring extends through the aperture in the cap member, between the face-to-face portions of the leaves and through the aperture in the housing. The leaves of the clutch are operative to resiliently embrace the post to retain it in the clutch for releasably securing the clutch on the earring.

U.S. Pat. No. 8,365,369, issued Feb. 5, 2013, to Fountoulakis, discloses a clutch for post earrings includes a housing which is open at one end thereof and has an aperture therethrough in the opposite end thereof, a cap member which is received on the open end of the housing and also has an aperture therethrough, and an insert of a resilient leaf member that includes a support piece captured between the housing flange and the cap member and a pair of leaves supported from the support piece. The leaves converge with respect to each other and are disposed in facing relationship for receiving a post therebetween. The post is receivable in the clutch so that it extends through the cap member and housing apertures and is received in frictional engagement between the leaves.

Self-locking of a clutch is undesirable condition and occurs when a post for a body piercing is secured in a clutch and cannot be withdrawn. Essentially, the force being applied to withdraw the post causes the spring elements to tighten in a fashion similar to a Chinese finger trap. Bending of the spring elements under the withdrawal force only exacerbates the problem, potentially causing it to permanently lock onto the post. If this condition results, removal of the clutch typically requires destruction of the clutch and is dangerous to the user. Self-locking can occur in poorly designed clutches which cannot accommodate dimensional or frictional inconsistency Well or if a clutch is engaged to a post of incompatible configuration.

In view of the foregoing, there is a need for apparatuses and systems that provide for simple, accurate, repeatable and safe body piercing. There is particularly a need for methods and apparatuses to allow efficient and hygienic securing of the post in a body piercing. There is also a need for such methods and apparatuses that protect the user from skin irritation and/or infection. In addition, there is a need for such apparatuses and methods to resist self-locking. Further, there is also a need for such methods and apparatuses to reduce manufacturing costs. As discussed hereafter, the present invention meets these and other needs.

SUMMARY OF THE INVENTION

A safety clutch for releasable securing of a post for a body piercing is disclosed. The post is guided through a hole in a plate to be secured (but removable) between a pair of cantilever spring elements bent from the edges of the plate into position on the back side of the plate. A dome shield is also secured to the edge of plate to cover the cantilever spring elements on back side of the clutch, the dome shield including one or more ventilation holes for reducing moisture accumulation within the dome shield. The dome shield blocks an end of the post extending between the cantilever spring elements from contacting the user and possibly puncturing skin as in the case of jewelry used to pierce the skin whereby the post has a sharp end to perform the initial piercing through the skin. The cantilever spring elements can be formed to include a groove or channel to carry the post in a fixed alignment, providing greater contact area to better secure the post when engaged. The plate, dome shield and cantilever spring elements can be efficiently manufactured by forming and stamping from a single piece of material.

A typical embodiment of the invention comprises a clutch for securing a post in a body piercing, including a plate section having a post hole therethrough and a pair of cantilever spring elements extending from opposite edges of the plate section and proximate to one another and aligned such that the cantilever spring elements partially intersect opposite sides of an imaginary cylindrical surface extending perpendicularly from the post hole on a backside of the plate section and a dome shield for blocking the post and enclosing the cantilever spring elements and secured to the plate section such that the imaginary cylindrical surface intersects the dome shield, the dome shield including at least one ventilation hole for reducing moisture accumulation within the dome shield.

In some embodiments, the at least one ventilation hole can comprise a pair of ventilation holes in opposite surfaces of the dome shield. The pair of ventilation holes can each comprise a tapered shape extending into the dome shield and forming a stop limiting deflection of the cantilever spring elements. Further, the pair of ventilation holes can be disposed behind the cantilever spring elements such that the post is blocked from the pair of ventilation holes. The dome shield can be secured to the plate section by a plurality of bent tabs extending from edges of the plate section. The cantilever spring elements can each comprise a widened area bent away from an axis of the imaginary cylindrical surface. The post hole of the plate section can be disposed in a recess base on a front side of the plate section.

In further embodiments, each cantilever spring element can include a channel disposed in alignment with the imaginary cylindrical surface. Each channel of the cantilever spring elements can comprise a channel radius at least a large as a post radius of the post.

In addition, the cantilever spring elements can each comprise a bend having a bend radius at least as large as half a diameter of the post hole and an incident angle with the post when engaged is no larger than 45 degrees and a bend angle is 105 degrees or greater and ends of the cantilever spring elements bend away from each other when the post is not engaged.

Another embodiment of the invention is directed to a method of producing a clutch for securing a post in a body piercing. An exemplary method comprises the steps of stamping and forming from a contiguous piece of planar material a plate section having a post hole therethrough and a pair of cantilever spring elements and a dome shield, the plate section and the dome shield having a connecting flange therebetween, bending the pair of cantilever spring elements to extend from opposite edges of the plate section to be proximate to one another and aligned such that the cantilever spring elements partially intersect opposite sides of an imaginary cylindrical surface extending perpendicularly from the post hole on a backside of the plate section, bending the connecting flange to enclose the cantilever spring elements with the dome shield such that the imaginary cylindrical surface intersects the dome shield, and securing the dome shield to the plate section. The method embodiment may be further modified consistent with other apparatus embodiments described herein.

BRIEF DESCRIPTION OF THE DRAWINGS

Referring now to the drawings in which like reference numbers represent corresponding parts throughout.

DETAILED DESCRIPTION OF THE PREFERRED EMBODIMENT

Figure 1A:
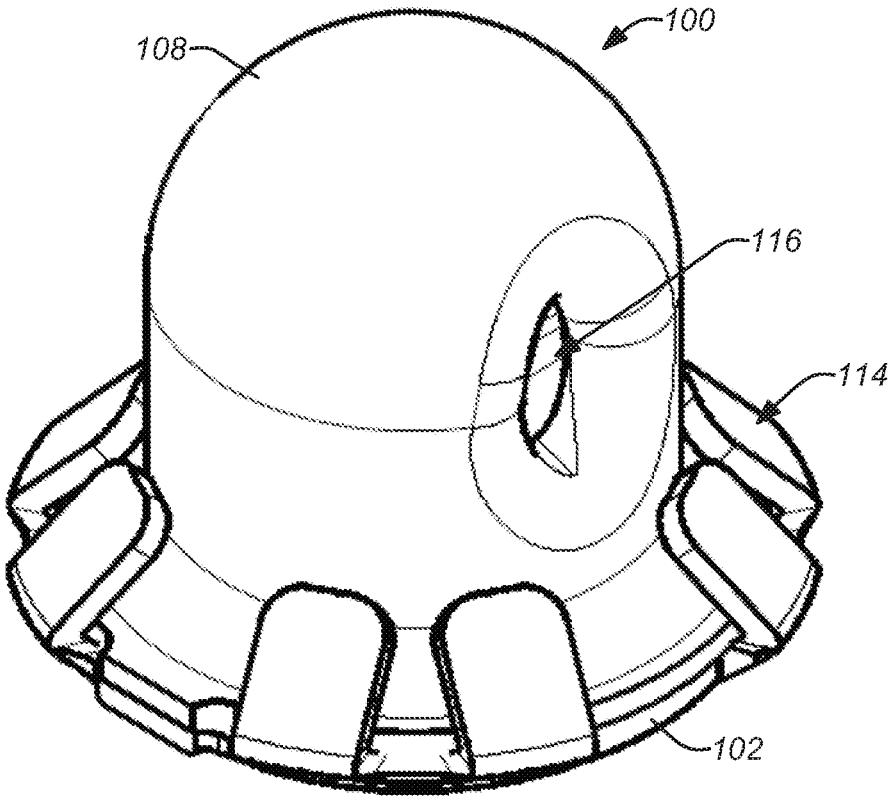
FIG. 1A illustrates an exemplary safety clutch embodiment of the invention.

In the following description including the preferred embodiment, reference is made to the accompanying drawings which form a part hereof, and in which is shown by way of illustration specific embodiments in which the invention may be practiced. It is to be understood that other embodiments may be utilized and structural changes may be made without departing from the scope of the present invention.

1.0 Overview

As previously mentioned, embodiments of the invention are directed to a novel safety clutch for releasable securing of a post in a body piercing and its method of production. The safety clutch can be employed with a body piercing in any part of the body and produced by any known method, e.g. using a hand operated piercing gun system or manually piercing.

The novel design yields a very compact, efficient, clutch that automatically aligns to a post and provides a very safe and secure but removable closure for a body piercing. In use, the post is guided through a post hole in a plate section to be held by pressure between a pair of cantilever spring elements bent from the edges of the plate section into opposing positions on the back side of the plate. A dome shield is also secured to the edge of plate to cover the cantilever spring elements on the back side of the clutch. The dome shield is used to block the end of the post from contacting the user and possibly infecting and/or puncturing skin.

Embodiments of the invention can employ one or more ventilation holes in the dome shield. These ventilation holes reduce any accumulation of moisture within the enclosed dome shield. The ventilation holes can be oriented to be disposed behind the widened areas of the cantilever spring elements which hold the post. In this way, the post cannot be inadvertently forced out one of the ventilation holes. In addition, the ventilation holes can be formed to have a tapered shape extending into the dome shield. The tapered shape also serves as a stop for the cantilever spring elements to prevent them from being bent too far under pressure from the post and also to further protect against self-locking. In one example embodiment, the safety clutch includes one post hole and two ventilation holes disposed behind the cantilever spring elements as detailed hereafter.

Embodiments of the invention can also employ features which operate to resist the occurrence of self-locking. Cantilever spring elements within the clutch employ large radius bends. In addition, these bends are made to have smooth transition surfaces where they contact the post. Ideally, the bend radius of each cantilever spring element is at least as large as half the diameter of the hole in the plate section. Further, the bend of each of the cantilever spring elements should be such that the incident angle with the post when engaged is no larger than 45 degrees and the bend angle is 105 degrees or greater. However, the ends of the cantilever spring elements should bend away from each other even in a relaxed state before the post is engaged. Furthermore, the tapered ventilation holes (which function as stops by limiting deflection of cantilever spring elements), also help prevent self-locking. If they contact the stops, the cantilever spring elements tend to straighten (along the bend radius) which effectively increases the bend radius and thereby avoids self-locking by the engaged post.

Another feature of the present invention comprises a channel or groove formed into each of the cantilever spring elements. The channels in the opposing cantilever spring elements guide and carry the post in a fixed alignment. In addition, the channels provide greater contact area with the post to better secure the post when engaged in the clutch. Each channel of the cantilever spring elements can employ a channel radius at least as large as a post radius of the post. The larger channel radius ensures that the post remains securely within cantilever spring element channel.

Another important feature of the present invention comprises a design that lends itself to automated production such that the complete device can be produced from a contiguous piece of material. The plate section, dome shield and cantilever spring elements can be produced from a single contiguous piece of sheet metal which is processed in an automated a series of stamping and forming operations. The plate section and the dome shield can be produced having a connecting flange therebetween. This connecting flange facilitates automatic alignment between the plate section and the dome shield when the connecting flange is bent such that the dome shield is disposed over the back side of the plate section (and the cantilever spring elements).

2.0 Safety Clutch

Figure 1B:
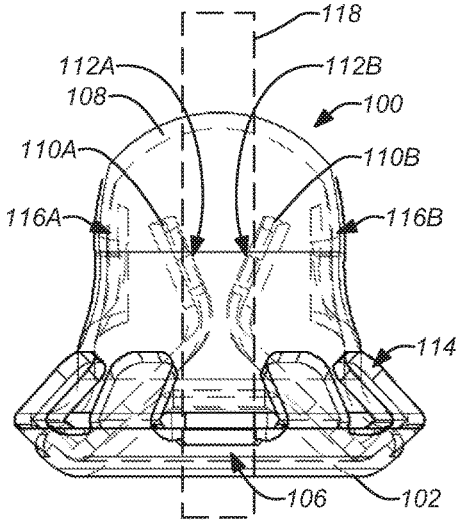
FIG. 1B illustrates a front view of the exemplary safety clutch embodiment of the invention.
Figure 1C:
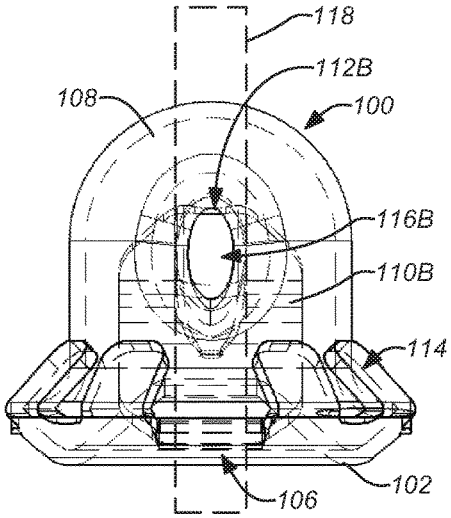
FIG. 1C illustrates a side view of the exemplary safety clutch embodiment of the invention.
Figure 1D:
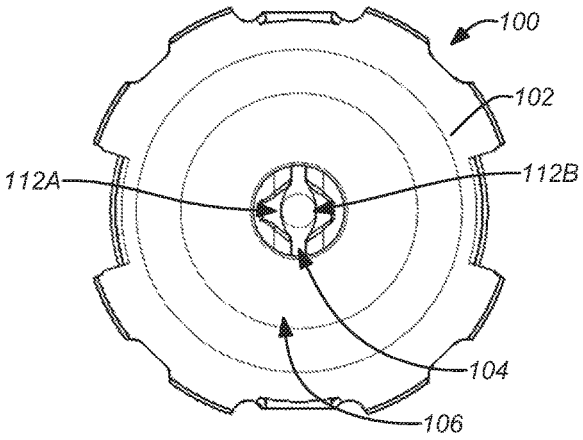
FIG. 1D illustrates a bottom view of the exemplary safety clutch embodiment of the invention.
Figure 1E:
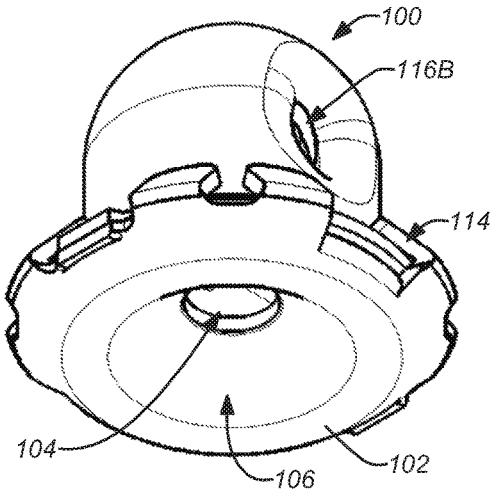
FIG. 1E illustrates an isometric view of the exemplary safety clutch embodiment of the invention.

FIGS. 1A-1E illustrate views of an exemplary safety clutch 100 embodiment of the invention. Note that FIGS. 1B and 1C show internal elements within the domed shield 108 in dashed lines. The safety clutch 100 comprises a plate section 102 which forms a base of the clutch 100 having a post hole 104 therethrough. The post hole 104 of the plate section 102 is disposed at the base of a recess 106 on the front side of the plate section 102.

A pair of cantilever spring elements 110A, 110B extend from opposite edges of the plate section 102. The cantilever spring elements 110A, 110B are bent into position to be proximate to one another and aligned such that the cantilever spring elements 110A, 110B partially intersect opposite sides of an imaginary cylindrical surface 118 extending perpendicularly from the post hole 104 on a backside of the plate section 102. The imaginary cylindrical surface 118 is shown in FIGS. 1B and 1C. Essentially, the imaginary cylinder 118 can be visualized in the position of the post when engaged with the clutch 100 but further extending in both directions.

Each cantilever spring element 110A, 110B includes a channel 112A, 112B disposed in alignment with the imaginary cylindrical surface. The channels 112A, 112B of the cantilever spring elements 110A, 110B contact the post to guide and carry it in alignment when it is engaged in the clutch 100 as described hereafter. To ensure full engagement with the post, each channel of the cantilever spring elements comprises a channel radius at least as large as a post radius of the post. In the example embodiment, the cantilever spring elements each comprise a widened area bent away from an axis of the imaginary cylindrical surface. The widened area accommodates initial entry of the post into the clutch at various angles such that it remains against the spring elements 110A, 110B until it is automatically guided into the channels 112A, 112B.

A dome shield 108 is disposed over the clutch 100 enclosing the cantilever spring elements 110A, 110B and secured to the plate section 102 at its edges. The dome shield 108 encloses the cantilever spring elements 110A, 110B such that the imaginary cylindrical surface intersects the dome shield 108. The dome shield 108 can be secured to the plate section 102 in any suitable manner. For example, the dome shield can be secured by bonding, crimping, and/or welding. In one example embodiment, the dome shield 108 is secured to the plate section 102 by a plurality of bent tabs 114 extending from edges of the plate section 102. In the example depicted, eight tabs 114 are employed in opposing pairs at each quadrant edge of a roughly circular plate section 102. The plurality of tabs 114 bent over a flared lip of the dome shield 108 to secure the shield 108 in alignment over the cantilever spring elements 110A, 110B.

Any moisture within the dome shield 108 is undesirable because it may lead to corrosion of the metallic clutch but also because it can promote infection. With a new piercing, there is a period of approximately four to six weeks during which the user is most susceptible to infection. Accordingly, in order to resist the presence of moisture being retained within the dome shield 108, one or more ventilation holes 116A, 116B are disposed in the dome shield 108 to promote evaporation of any moisture which may accumulate within the shield 108. In the example depicted, a pair of ventilation holes 116A, 116B are disposed in opposite surfaces of the dome shield 108 and aligned with the cantilever spring elements 110A, 110B. However, those skilled in the art will understand that any number of ventilation holes can be made in the dome shield 108 around the sides of the dome shield 108. Only the top of the dome shield 108 should remain without a ventilation hole as this area blocks the post from contacting the user.

Alignment of the ventilation holes 116A, 116B with the cantilever spring elements 110A, 110B ensures that the post cannot inadvertently be directed through one of the ventilation holes 116A, 116B when it is engaged into clutch 100. The wide contact areas of the cantilever spring elements 110A, 110B block the post from the ventilation holes 116A, 116B. Those skilled in the art will appreciate that other configurations for ventilation holes in the dome shield 108 can also be readily employed including any suitable combination of number, size, shape, and placement on the dome shield.

The ventilation holes 116A, 116B are formed to have a tapered shape extending into the dome shield 108. The tapered shape also serves as a stop for the cantilever spring elements to prevent them from being bent too tar under pressure front the post See e.g. FIG. 1B showing the distance between the ends of each cantilever spring element 110A, 110B and the adjacent tapered extension of the ventilation hole 116A, 116B. Since contact with the cantilever spring elements is made with the tapered shape of the ventilation holes at their ends, these stops tend to flatten or straighten the cantilever spring elements. This flattening or straightening of the cantilever spring elements 110A, 110B by the ventilation hole 116A, 116B stops further protects against self-locking as it increases the bend angle, θ, as described hereafter.

It should also be noted that in order to function the shield 108 only needs to occupy the area intersecting the imaginary cylinder (representing an engaged post) as previously described. Accordingly, the side structure can be fairly minimal, mostly occupied by ventilation holes; the side structure need only be sufficient to support the shield area at the top of the dome for blocking the post end.

In general, a post in a body piercing is cylindrical. However, posts for body piercing can vary, particularly at the post end where it penetrates the body and engages the clutch. Embodiments of the invention can be employed with various post configurations. The channels 112A, 112B of the cantilever spring elements 110A, 110B automatically guide and align the post in the clutch across a wide range of post configurations, e.g. with or without a notch and across a range of post diameters.

Figure 2A:
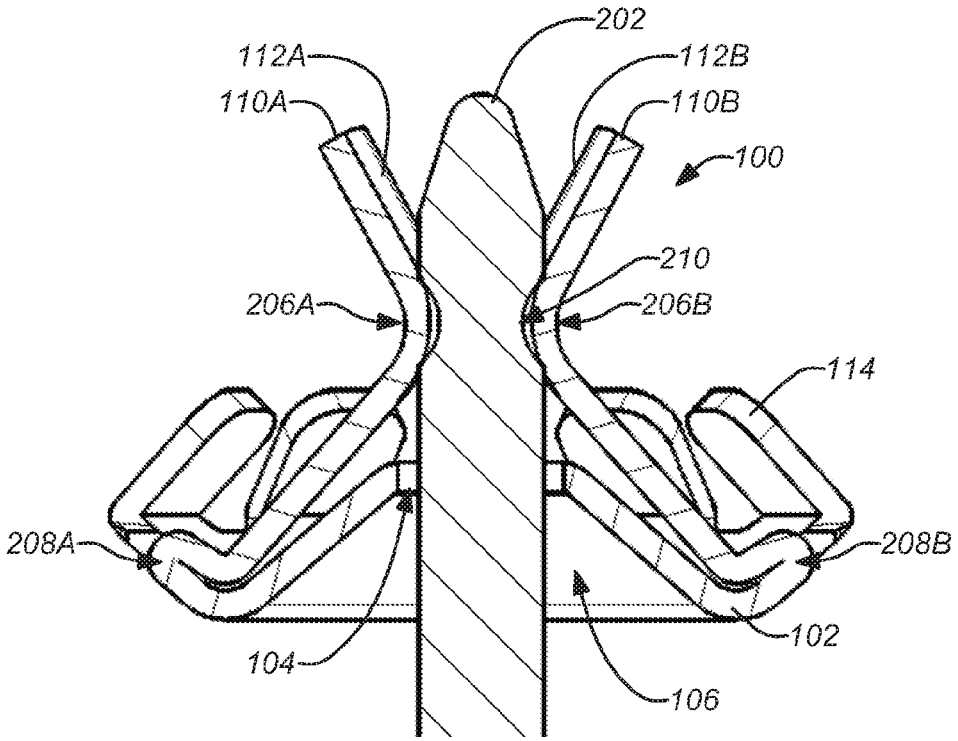
FIG. 2A illustrates a cross section view of an exemplary safety clutch embodiment of the invention showing a notched post of a body piercing engaged (shown without the dome shield place)

For example, FIG. 2A illustrates a cross section view of an exemplary safety clutch 100 embodiment of the invention showing a notched post 202 of a body piercing engaged (shown without the dome shield 108 in place). The notched post 202 can be used to engage bends 206A, 206B along the lengths of the cantilever spring elements 110A, 110B in order to lock the post engagement to a specified depth. At the same time, the channels 112A, 112B of the cantilever spring elements 110A, 110B keep the post 202 perpendicularly aligned to the hole 104 of the clutch 100. The post 202 can employ a sharpened end as shown or a blunted end. As previously mentioned, the imaginary cylindrical surface used to describe the location of the cantilever spring elements 110A, 110B can be visualized in the position of a post, e.g. post 204 of FIG. 2B.

Figure 2B:
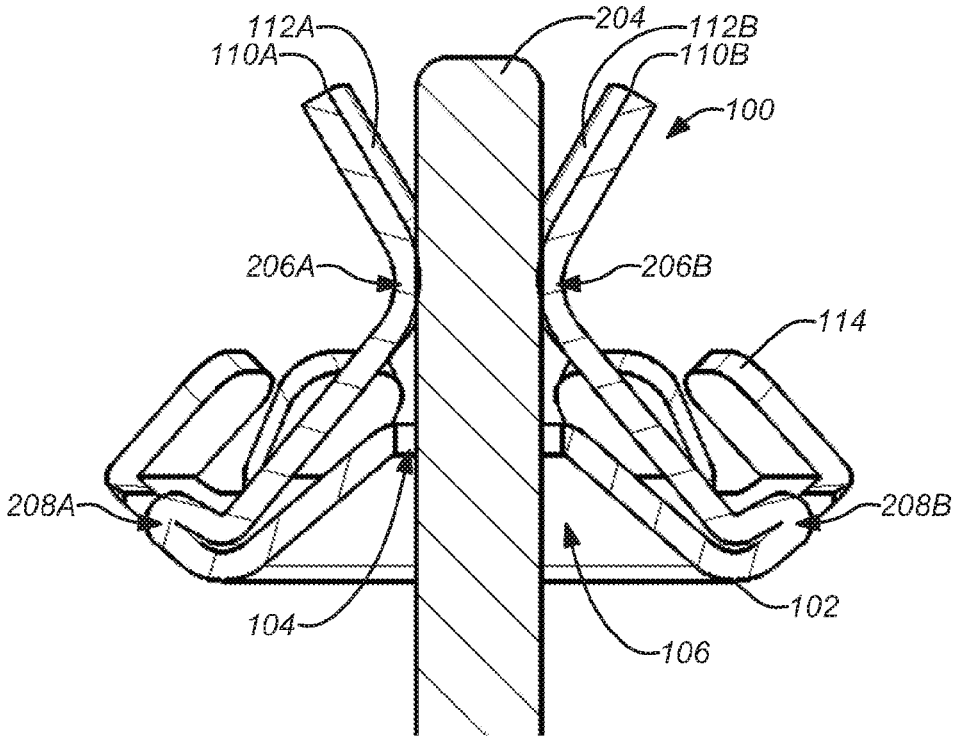
FIG. 2B illustrates a cross section view of an exemplary safety clutch embodiment of the invention showing a straight post of a body piercing engaged (shown without the dome shield in place)

In another example, FIG. 2B illustrates a cross section view of an exemplary safety clutch 100 embodiment of the invention showing a straight post 204 of a body piercing engaged (shown without the dome shield 108 in place). Here, no notch is employed to engage the bends 206A, 206B along the lengths of the cantilever spring elements 110A, 110B. The post 204 is secured by friction against the pressure of the cantilever spring elements 110A, 110B. The depth of the post 204 engagement can be adjusted. However, the channels 112A, 112B of the cantilever spring elements 110A, 110B still keep the post 204 perpendicularly aligned to the hole 104 of the clutch 100. In addition, the channels 112A, 112B improve the frictional hold of the cantilever spring elements 110A, 110B by enlarging the contact area with the post 204. The post 204 can employ a blunted end as shown or a sharpened end.

FIGS. 2A and 2B illustrate cross section views of an exemplary safety clutch embodiment of the invention showing a notched post and a smooth post, respectively, of a body piercing engaged (shown without the dome shield in place). These cross section views shove that the spring force against the post is developed in the two bends 208A, 208B where each cantilever spring element 110A, 110B joins the plate section 102. the spring force can be sized by the thickness, t, and width, w, of the material in area of the two bends 208A, 208B in combination with the average length from the two bends 208A, 208B to the contact region against the post (i.e. approximately at the bends 206A, 206B of the cantilever spring elements 110A, 110B) as will be understood by those skilled in the art. See FIG. 2C described hereafter showing the thickness, t, of the cantilever spring elements 110A, 110B. See FIG. 3B described hereafter showing width, w, of spring element 110B and the difference in width with the widened area where the post contacts. It should be noted that the critical width, w, for determining the spring force where each cantilever spring element 110A, 110B joins the plate section 102 is significantly narrower than the widened area where the post contacts the cantilever spring element 110A, 110B. Thus, the spring force can be tuned independent from sizing the widened area and channel for contacting the post.

Figure 2C:
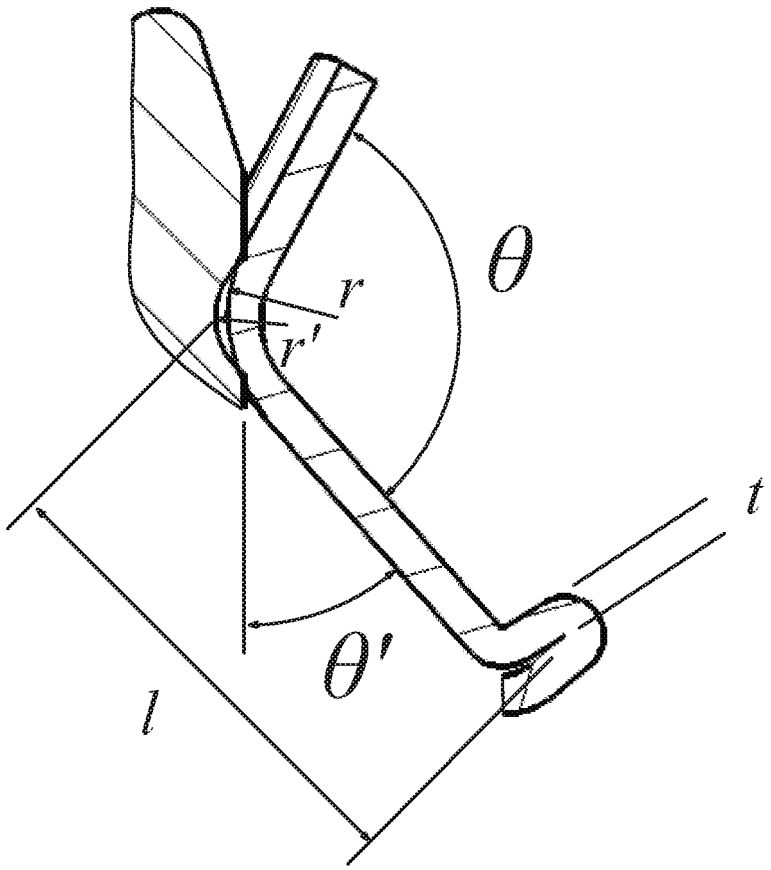
FIG. 2C illustrates key properties defining the configuration of the cantilever spring elements in order to reduce the chance of self-locking.
Figure 3A:
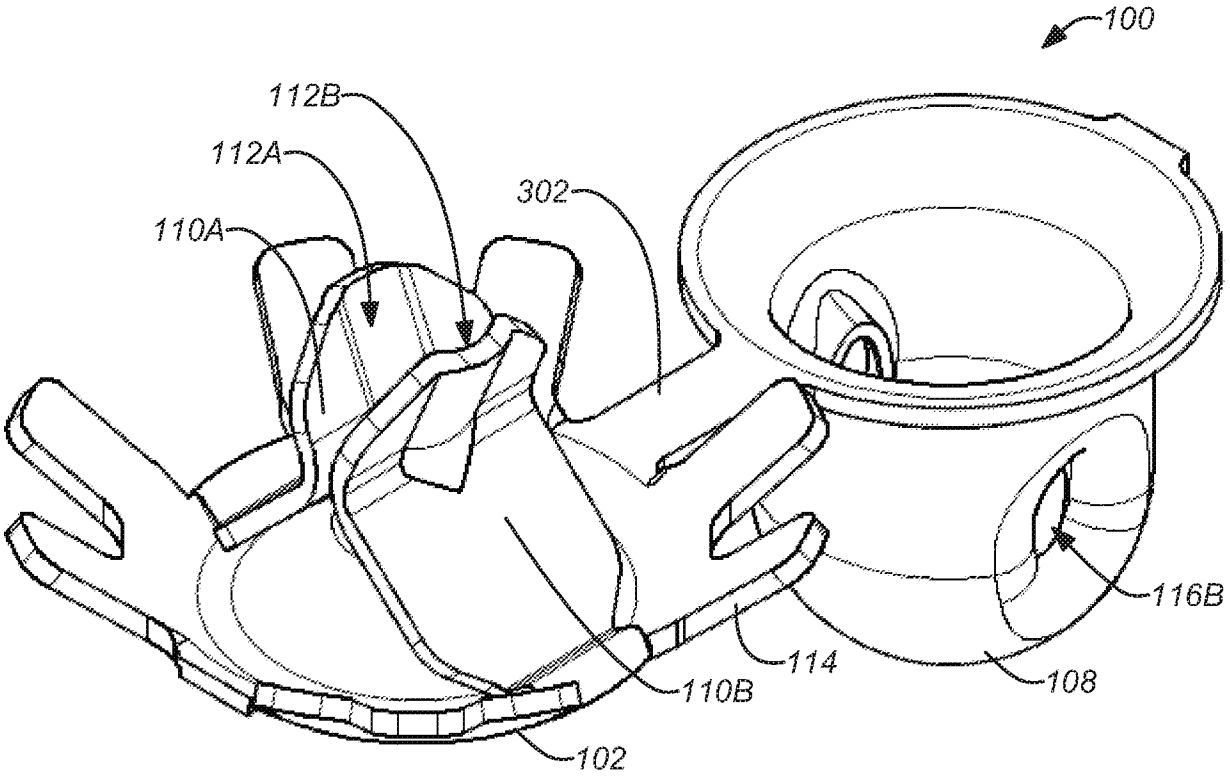
FIG. 3A illustrates a view of a pre-assembled exemplary safety clutch embodiment of the invention.
Figure 3B:
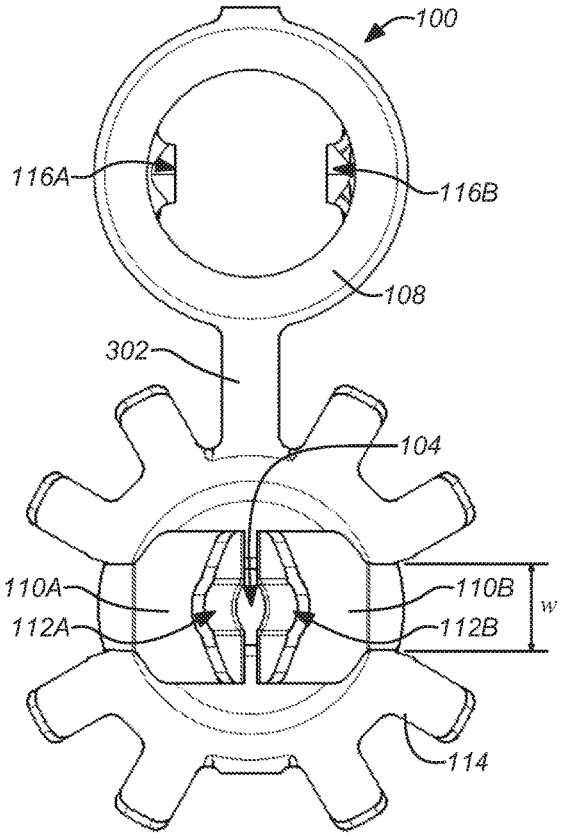
FIG. 3B illustrates a front view of the pre-assembled exemplary safety clutch embodiment of the invention.
Figure 3C:
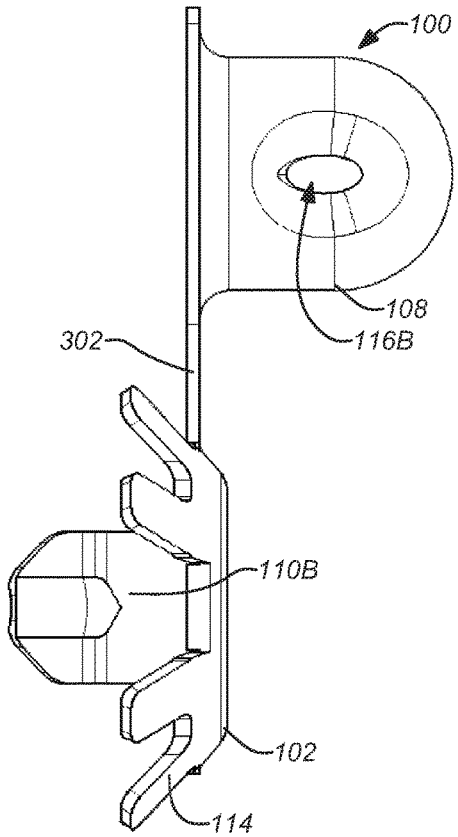
FIG. 3C illustrates a side view of the pre-assembled exemplary safety clutch embodiment of the invention.
Figure 3D:
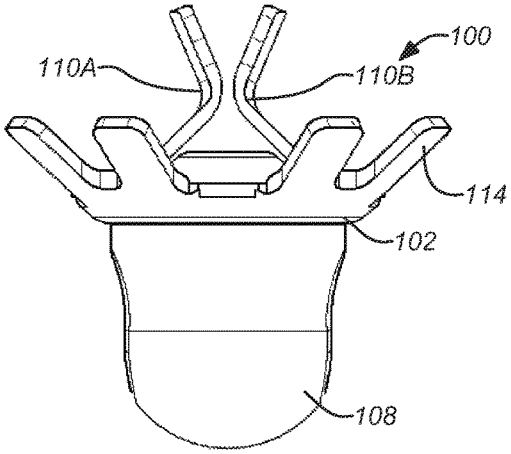
FIG. 3D illustrates a bottom view of the pre-assembled exemplary safety clutch embodiment of the invention.
Figure 3E:
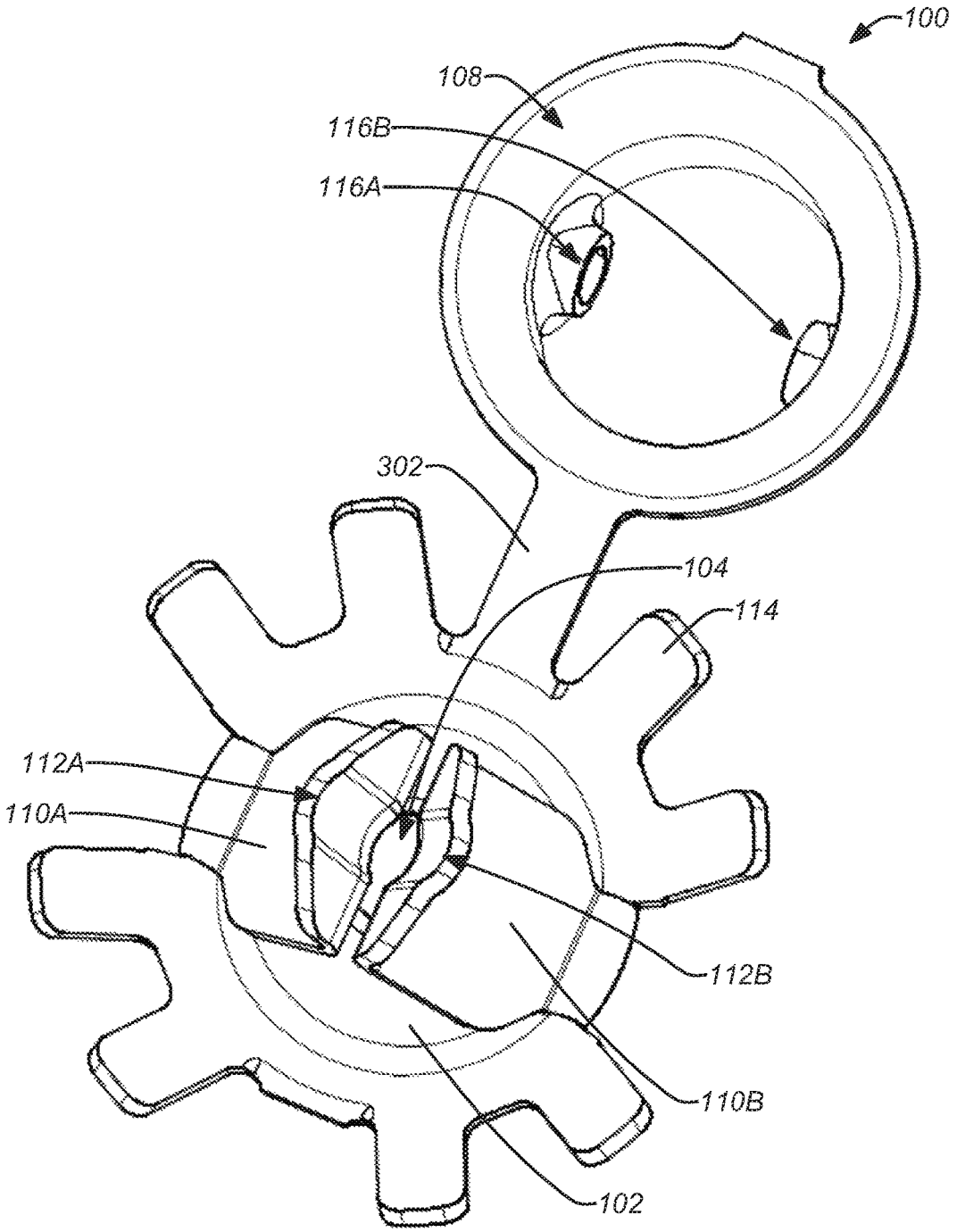
FIG. 3E illustrates an isometric view of the pre-assembled exemplary safety clutch embodiment of the invention.

FIG. 2C illustrates key properties defining the configuration of the cantilever spring elements 110A, 110B in order to reduce the chance of self-locking. The key properties comprise the average length, l, cantilever spring element thickness, t, bend angle, θ, post incident angle, θ', bend radius, r, of the outer surface of the cantilever spring element, and notch radius, r', of the post. The novel safety clutch incorporates many features to make it particularly resistant to self-locking.

The bends 206A, 206B of the cantilever spring elements 110A, 110B are made to have smooth transition surfaces where they contact the post to prevent any burr or edge of the post from snagging. In addition, there are two important angles in the configuration of the cantilever spring elements 110A, 110B, the incident angle with the post (or with the imaginary cylindrical surface 118), θ', and the bend angle, θ. The initial incident angle, θ', of the cantilever spring elements 110A, 110B to the imaginary cylindrical surface 118, i.e. prior to insertion of the post, is fixed by the shape of the recess 106 in the plate section 102. As shown in FIG. 1B, the cantilever spring elements 110A, 110B rest directly against the back side of the recess 106. Accordingly, the shape of the recess 106 sets the initial angle, θ'. However, with the post inserted, the angle, θ', is reduced as the cantilever spring elements 110A, 110B are forced outward by the post. This can be seen by comparing FIG. 1B with FIGS. 2A and 2B. The bend angle, θ, is the overall angle between the incident line with the post and the end of the cantilever spring element 110A, 110B. A larger bend angle reduces the likelihood of self-locking occurring. However, some bend angle is desirable to aid retention of the post. If no bend angle were used, i.e. a straight spring elements were used, the clutch might actually resist retention of the post or possibly eject the post.

Just as the channel radius should be larger than the post radius, the size of the radius applied to the bend 206A, 206B is also very important. The size of the radius, r, of the bends 206A, 206B should be made to be large. Particularly, it should be larger than the radius, r', of the post notch 210. If a sharp bend is employed, i.e. a creased bend, self-locking is much more likely as the notch of the post can easily catch on the crease and cause the two cantilever spring elements to be forced together as the post is withdrawn as will be understood by those skilled in the art.

Embodiments of the invention can employ a novel combination of elements in order to reduce the chance of self-locking in the clutch. The incident angle, θ', should be no larger than 45 degree's when engaged with the post. In the example embodiment, the cantilever spring elements 110A, 110B begin with an incident angle, θ', of approximately 45 degrees against the backside of the recess 106 before a post is engaged. Engaging a post forces the cantilever spring elements 110A, 110B outward, resulting in an incident angle, θ', of approximately 40 degrees. In addition, the bends 206A, 206B of each cantilever spring element 110A, 110B should have an angle, θ, greater than 90 degrees. Preferably, the bends 206A, 206B are to angles 105 degrees or greater. The example embodiment employs bend angles, θ, of approximately 110 degrees. Finally, the bend radius, r, should be at least as large as half the diameter of the hole 104 in the plate section 102. This size relationship between the bend radius and the hole helps ensure that the post will be smoothly withdrawn without catching on either cantilever spring element 110A, 110B causing the clutch to self-lock. If a notched post is employed, the bend radius, r, should also be larger than the notch radius, r', of the post.

It should also be noted that the relative sizes shown in the figures are only exemplary; those skilled in the art may develop specific designs having any reasonable dimensions applying the described principles of the applicable embodiment of the invention.

3.0 Production of a Safety Clutch

The novel design of the safety clutch readily facilitates efficient manufacturing. Typically, a safety clutch embodiment can be produced from sheet metal, e.g. comprising silver or gold, or any other suitable material known in the art. The safety clutch can be produced from a sheet metal ribbon continuously processed in a series of stamping and forming steps as will be understood by one skilled in the art. The production process is well-suited for automation. One significant feature of the novel clutch design is that it can be produced from a contiguous material piece.

FIGS. 3A-3E illustrate views of a pre-assembled exemplary safety clutch 300 embodiment of the invention. As shown, the plate section 102 (including the cantilever spring elements 110A, 110B) and the dome shield 108 are formed as a contiguous piece. This state of assembly shows the formed dome shield 108 and the plate section 102 with cantilever spring elements 110A, 110B as a single contiguous piece connected by flange 302. The pre-assembled safety clutch 300 is shown with cantilever spring elements 110A, 110B stamped, formed and bent into position and with the dome shield also formed with ventilation holes 116A, 116B.

In subsequent operations, the connecting flange 302 is bent such that the dome shield 108 encloses the cantilever spring elements 110A, 110B and the tabs 114 extending from edges of the plate section 102 are bent over the flared end of the dome shield 108 to secure it to the plate section 102. Those skilled in the art will appreciate that the formation of the pre-assembled exemplary safety clutch 300 from a single contiguous material piece with the connecting flange 302 allows for automatic alignment of the components for subsequent assembly. When the connecting flange 302 is bent to fold the dome shield into position over the plate section (and cantilever spring elements) it is automatically aligned in position. This greatly improves the manufacturing efficiency of the device. Optionally, the folded flange 302 can be clipped off after completing the assembly. Even if the folded flange is clipped off, the plate section 102 and spring elements 110A, 110B still remain formed from a single contiguous piece of material.

The resulting safety clutch 100, e.g. as shown in FIGS. 1A-1E, can be produced from flat sheet metal through a series of stamping and forming operations, the pre-assembled safety clutch 300 being a key intermediate state of assembly. Those skilled in the art can readily develop the necessary prior and subsequent operations based on the description herein to yield the safety clutch 100 without undue experimentation.

Figure 4:
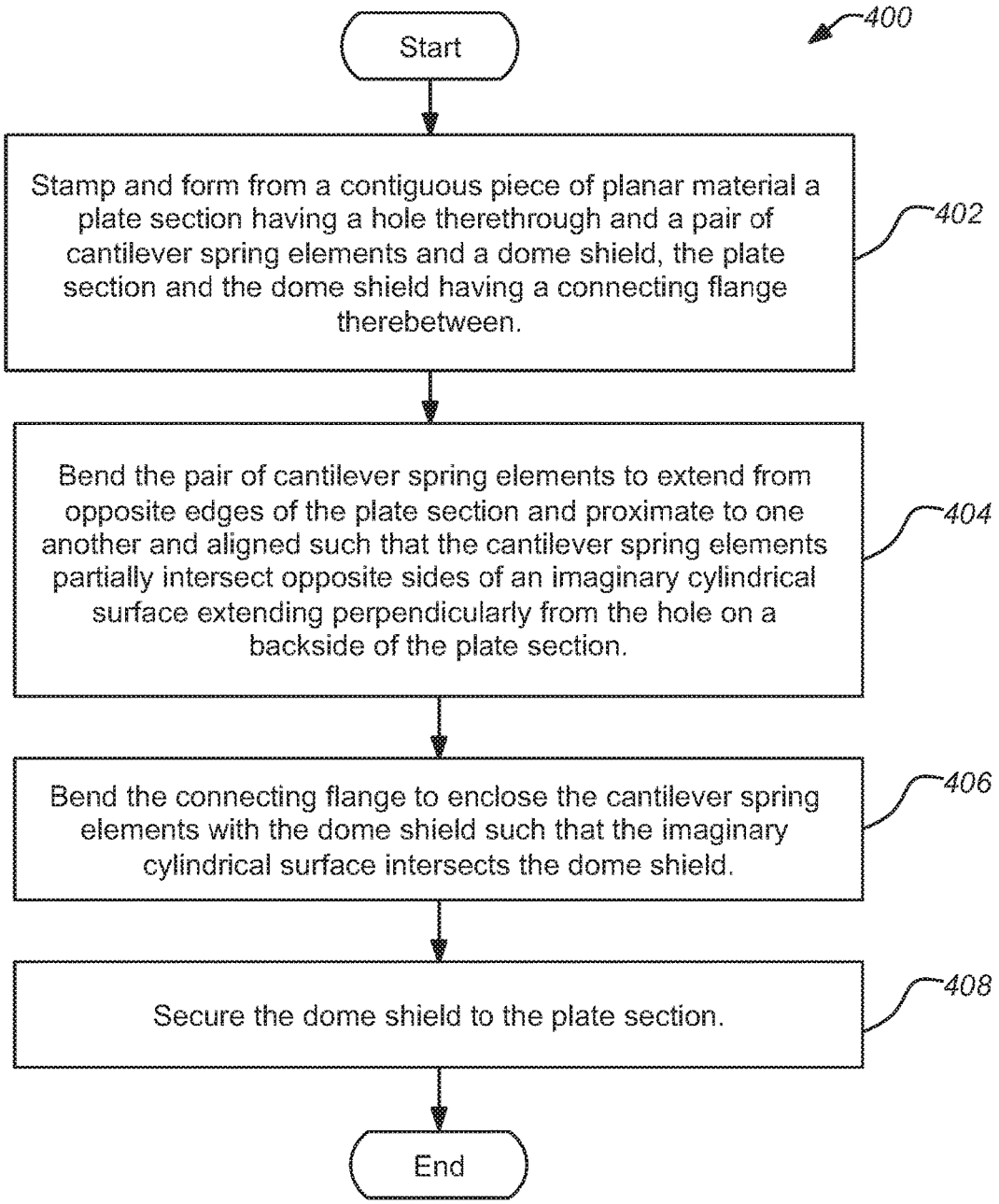
FIG. 4 is a flowchart of an exemplary method embodiment of the invention for producing a safety clutch.

FIG. 4 is a flowchart of an exemplary method 400 embodiment of the invention for producing an safety clutch. The method begins with an operation 402 of stamping and forming from a contiguous piece of planar material a plate section having a hole therethrough and a pair of cantilever spring elements and a dome shield. The plate section and the dome shield have a connecting flange therebetween. In operation 404, the pair of cantilever spring elements are bent to extend from opposite edges of the plate section to be proximate to one another and aligned such that the cantilever spring elements partially intersect opposite sides of an imaginary cylindrical surface extending perpendicularly from the hole on a backside of the plate section. Following this, in operation 406, the connecting flange is bent to enclose the cantilever spring elements with the dome shield such that the imaginary cylindrical surface intersects the dome shield. Finally, in operation 408, the dome shield is secured to the plate section.

The described operations can be performed in any suitable order as will be understood by those skilled in the art. As previously discussed, the manufacturing method lends itself to automation; automated production using the described method can be readily developed employing a metal ribbon from which to stamp and form the safety clutch elements from a contiguous material piece, separating each clutch from the metal ribbon as a last operation. Those skilled in the art can readily automate the method as described.

This concludes the description including the preferred embodiments of the present invention. The foregoing description of the preferred embodiment of the invention has been presented for the purposes of illustration and description. It is not intended to be exhaustive or to limit the invention to the precise form disclosed. Many modifications and variations are possible in light of the above teaching.

It is intended that the scope of the invention be limited not by this detailed description, but rather by the claims appended hereto. The foregoing specification, examples and data provide a complete description of the manufacture and use of the apparatus and method of the invention. Since many embodiments of the invention can be made without departing from the scope of the invention, the invention resides in the claims hereinafter appended.

What is claimed is:

1. A clutch for securing a post in a body piercing, comprising:

a plate section having a post hole therethrough and a pair of cantilever spring elements extending from opposite edges of the plate section and proximate to one another and aligned such that the cantilever spring elements partially intersect opposite sides of an imaginary cylindrical surface extending perpendicularly from the post hole on a backside of the plate section; and a dome shield for blocking the post and enclosing the cantilever spring elements and secured to the plate section such that the imaginary cylindrical surface intersects the dome shield, the dome shield including at least one ventilation hole for reducing moisture accumulation within the dome shield.

2. The clutch of claim 1, wherein the at least one ventilation hole comprises a pair of ventilation holes in opposite surfaces of the dome shield.

3. The clutch of claim 2, wherein the pair of ventilation holes each comprise a tapered shape extending into the dome shield and forming a stop limiting deflection of the cantilever spring elements.

4. The clutch of claim 2, wherein the pair of ventilation holes are disposed behind the cantilever spring elements such that the post is blocked from the pair of ventilation holes.

5. The clutch of claim 1, wherein each cantilever spring element includes a channel disposed in alignment with the imaginary cylindrical surface.

6. The clutch of claim 5, wherein each channel of the cantilever spring elements comprises a channel radius at least as large as a post radius of the post.

7. The clutch of claim 1, wherein the cantilever spring elements each comprise a bend having a bend radius at least as large as half a diameter of the post hole and an incident angle with the post when engaged is no larger than 45 degrees and a bend angle is 105 degrees or greater and ends of the cantilever spring elements bend away from each other when the post is not engaged.

8. The clutch of claim 1, wherein the dome shield is secured to the plate section by a plurality of bent tabs extending from edges of the plate section.

9. The clutch of claim 1, wherein the cantilever spring elements each comprise a widened area bent away from an axis of the imaginary cylindrical surface.

10. The clutch of claim 1, wherein the post hole of the plate section is disposed in a recess base on a front side of the plate section.

* * * * *